US007088305B2

(12) United States Patent
Flask et al.

(10) Patent No.: US 7,088,305 B2
(45) Date of Patent: Aug. 8, 2006

(54) DUAL RANGE ANTENNA

(75) Inventors: Orin F. Flask, Minneapolis, MN (US); Robert Marks, New Hope, MN (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 11/055,582

(22) Filed: Feb. 10, 2005
(Under 37 CFR 1.47)

(65) Prior Publication Data

US 2005/0243008 A1 Nov. 3, 2005

Related U.S. Application Data

(60) Provisional application No. 60/543,332, filed on Feb. 10, 2004.

(51) Int. Cl.
*H01Q 21/00* (2006.01)

(52) U.S. Cl. ..... 343/794; 343/726

(58) Field of Classification Search ..... 343/794, 343/764, 723, 757, 805, 809, 727
See application file for complete search history.

(56) References Cited

U.S. PATENT DOCUMENTS

| | | | | |
|---|---|---|---|---|
| 3,522,608 | A * | 8/1970 | Von Fange | 343/702 |
| 3,739,388 | A * | 6/1973 | Callaghan | 343/726 |
| 4,864,632 | A * | 9/1989 | Moriyama et al. | 725/78 |
| 6,965,353 | B1 * | 11/2005 | Shirosaka et al. | 343/802 |
| 2003/0090423 | A1 * | 5/2003 | Horii | 343/727 |
| 2004/0207561 | A1 * | 10/2004 | Wang | 343/720 |

OTHER PUBLICATIONS

Malester, Jeff, "Antennas Advance Into The Digital Age", *TWICE*, Aug. 8, 2005, 3 pages.

* cited by examiner

*Primary Examiner*—Hoang V. Nguyen
*Assistant Examiner*—Tung Le
(74) *Attorney, Agent, or Firm*—Foley & Lardner LLP

(57) ABSTRACT

An antenna system that for use in both high density areas and rural areas while still obtaining acceptable reception in both locations. The antenna system includes a switching mechanism that permits the user to select between a lower gain range, appropriate for high density areas, and a higher gain range, which is more conducive to rural areas where UHF and VHF signals tend to be the weakest. This system provides the user with greater utility and performance and broader compatibility with television markets of varying sizes.

9 Claims, 8 Drawing Sheets

DUAL RANGE ANTENNA

The present Application claims the benefit of and priority as available under 35 U.S.C. §§ 119–21 to the following U.S. patent application (which is incorporated by reference in the present Application): U.S. Provisional Patent Application 60/543,332, tilted "DUAL RANGE ANTENNA" filed Feb. 10, 2004.

FIELD OF THE INVENTION

Background of the Invention

The present invention relates generally to antennae. More particularly, the present invention relates to television antennae that can be effectively used in both high density areas, where signals are strong, and in rural, low density areas, where signals are weak. A variety of types of antennae are conventionally known for use with televisions. Currently, television signals are broadcast in both UHF and VHF format. Both UHF and VHF signals tend to be the strongest near urban or "high density" areas. These signals tend to be significantly weaker in rural or "low density" areas.

Due to these typical differences in signal strength between high and low density areas, television sets and their antennas must be designed to manage both very strong and very weak incoming signals. In particular, antennas must provide strong enough signals in rural areas but not too much signal in high density areas. Thus, different antennas are normally selected for use in these different areas If an antenna is designed to adequately receive and process signals in a high density area, it likely will not provide adequate amplification for a signal in a low density area, resulting in poor reception. Conversely, an antenna designed for reception in a low density area can be overloaded if it receives a strong enough signal in a high density area. This leads to poor reception and undesirable cross-talk and interference between channels. In addition, stronger signals drive components into nonlinear ranges and cross-modulating weaker signals in a manner that causes herringbone and other undesirable patterns, as well as signal clipping. Additionally, factors including natural signal barriers, such as mountains and valleys, as well as man-made barriers such as buildings can influence performance as well.

In response to this issue, users have traditionally purchased two different antennae designs to accommodate both rural and urban geographic locations (corresponding to weak and strong UHF and VHF signal strength). Retailers have therefore been required to carry different types of antennae in their stores, adding to the retailers' inventory and also creating additional purchasing complexity on the user's part.

SUMMARY OF THE INVENTION

It is therefore an object of the invention to provide an improved antenna system that is capable of receiving both very strong and weak signals, providing for reception for UHF and VHF signals of varying strength.

It is another object of the invention to provide an improved antenna system that provides the user with a simple mechanism of altering the antenna's sensitivity to receiving UHF and VHF signals of varying strength.

It is a further another object of the invention to provide an improved antenna system that is equally effective in both high density and low density areas.

In accordance with the above and other objects, an antenna system is provided that permits the user to use the same antenna system in both high density areas and low density areas while still obtaining acceptable reception in both locations. The antenna system of the present invention includes a switching mechanism that permits the user to select between a lower gain range, appropriate for high density areas, and a higher gain range, which is more conducive to rural areas where UHF and VHF signals tend to be the weakest. This "dual range" antenna provides the user with greater utility and performance and broader compatibility with television markets of varying sizes. This antenna system also reduces the need of manufacturers to offer several different models of antenna, reducing the manufacturer's tooling and inventory carrying costs. The antenna may also be equipped with separate, continuously-variable gain controls for independent adjustment of UHF and VHF gain.

DETAILED DESCRIPTION OF THE FIGURES

DETAILED DESCRIPTION OF THE INVENTION

Figure 1:
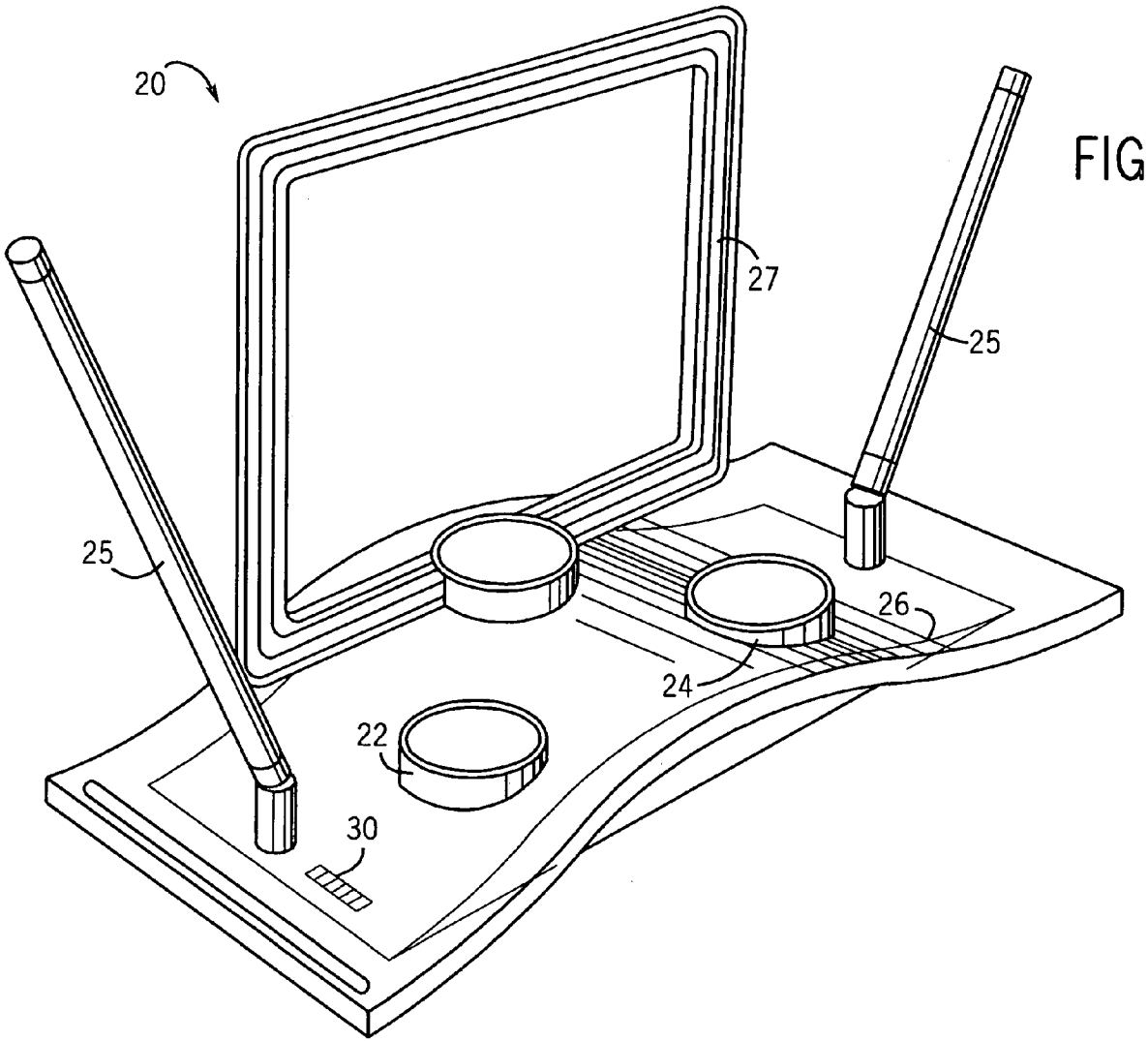
FIG. 1 is a perspective view an improved antenna system constructed in accordance with one embodiment of the present invention.
Figure 2:
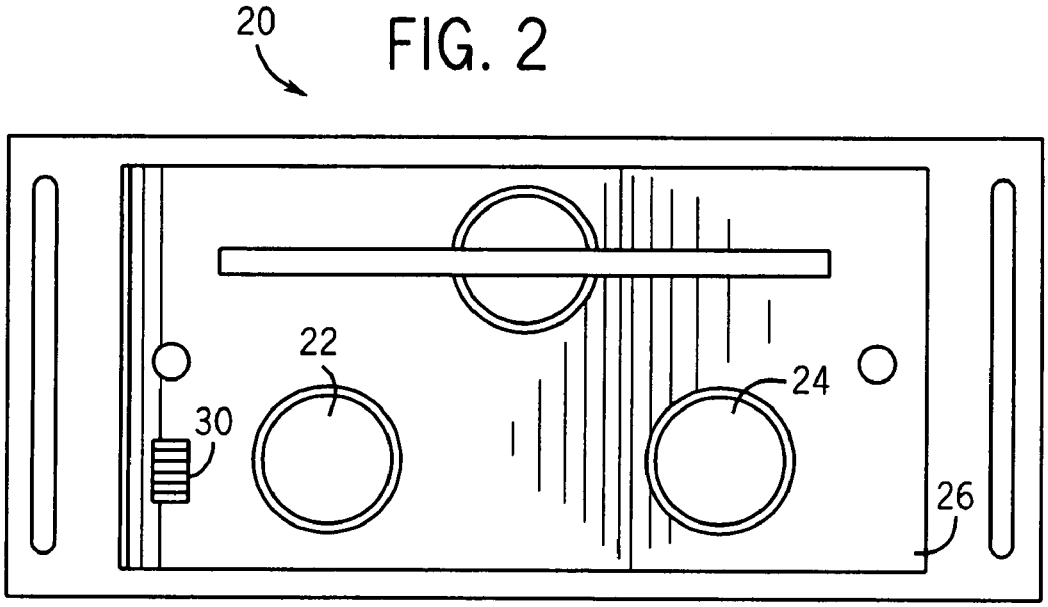
FIG. 2 is a top plan view of the improved antenna system of FIG. 1.
Figure 3:
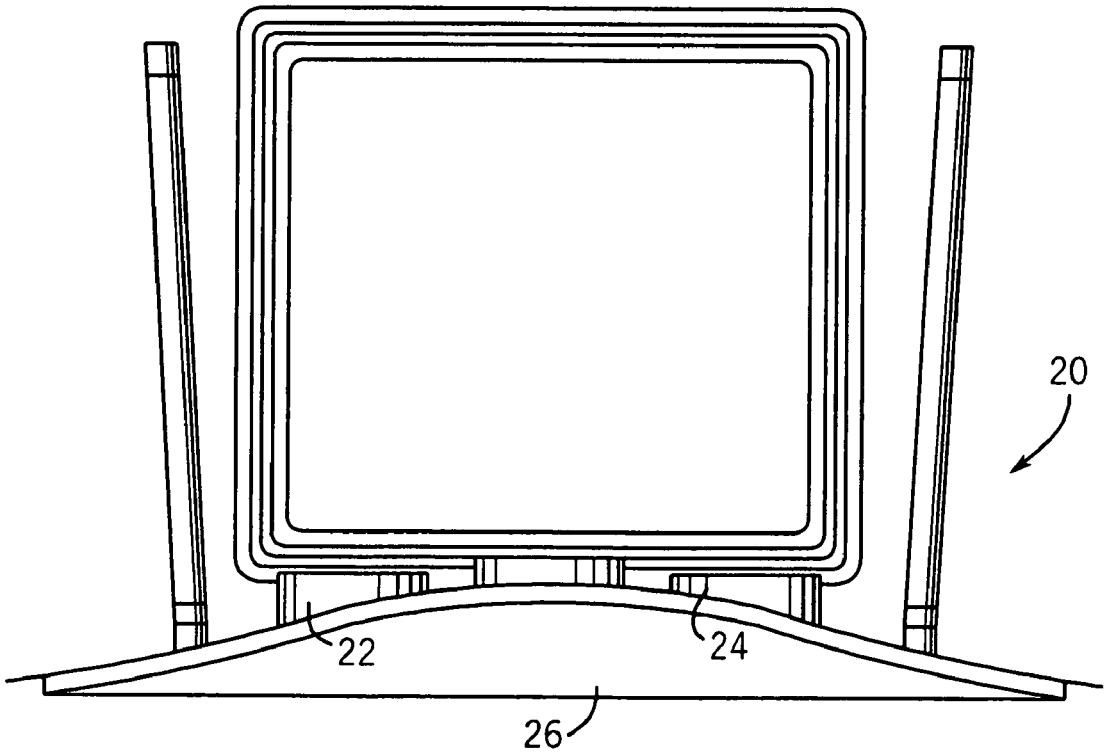
FIG. 3 is a front elevation view of the improved antenna system of FIG. 1.

A dual-range antenna system constructed in accordance with the principles of the present invention is shown generally at 20 in FIGS. 1–3. The dual-range antenna system 20 comprises a UHF gain control potentiometer 22 and a VHF gain control potentiometer 24 positioned on a base 26. The dual-range antenna system 20 includes a pair of VHF antennae 25 and a UHF antenna 27. Both the VHF antennae 25 and the UHF antenna 27 are each coupled to a pair of wires (not shown).

In the particular embodiment shown herein, the UHF gain control potentiometer 22 and the VHF gain control potentiometer 24 are always powered. However, it is also possible to have the UHF and VHF gain control potentiometers 22 and 24 include an on-off switch (50 in FIG. 8, for example). A single master on-off switch 50 may be provided, and it may include separate switch sections (not shown) to bypass the amplifiers. Alternatively, a separate on-off switch may be provided for each of UHF and VHF. In this alternative embodiment, the switch for the UHF gain control potentiometer 22 and/or the VHF gain control potentiometer 24 can be located on the respective gain control potentiometers 22 and 24 or on the top or side of the base 26. In addition to each gain control potentiometer having its own on/off switch, a single on/off switch can be added to the VHF gain control potentiometer 24 that can be used for both the VHF and UHF signals.

The dual range antenna system 20 also includes a pair of switches 72 and 74 (FIG. 8) which are ganged together in order to form a single switch 30, shown in FIG. 1. The single switch 30 allows the user to switch between two different gain ranges. A first gain range, in one embodiment of the invention, goes from around zero to around twenty db (the "lower gain range"). This lower gain range is appropriate for urban or high density neighborhoods where VHF and UHF signals tend to be particularly strong. The second gain range, in the same embodiment of the invention, ranges from around twenty to around forty-five db (the "higher gain range"). This higher gain range is conducive to rural or low density neighborhoods where VHF and UHF signals tend to be particularly weak. The gain ranges may overlap.

The dual range antenna system 20 counters the problems associated with signal overload of a higher gain range prior art antenna in strong VHF and UHF signal areas, as well as the poor reception of a low gain range prior art antenna in weak VHF and UHF signal locations. The dual range antenna system 20 of the present invention is capable of serving the reception needs of both urban and rural antenna users. To switch between a lower gain range and a higher gain range, the user simply moves the switch 30 to the appropriate position. The user is then free to adjust the UHF gain control potentiometer 22 and the VHF gain control potentiometer 24 individually as necessary to optimize the signal reception and minimize snow while minimizing distortion due to overloading.

VHF and UHF amplifiers may use variable transistor biasing arrangements to vary the gain of individual gain stages. For the present invention, one method of altering the gain range is to vary the voltage supplied to the amplifier's power input, as is described below. A simple switch, such as a slide switch, can be used to short a fixed resistor in series with the power supply current. Alternatively, or as illustrated here, UHF and VHF gain control potentiometers 22 and 24, when individually adjusted, permit fine adjustment of the VHF and UHF antenna gain independently of each other. Briefly described, these two potentiometers each enable DC power to be supplied to the respective VHF and UHF amplifiers from taps or sliders of the two potentiometers which are connected across a DC voltage supply. This will be explained in the discussion accompanying FIG. 8, which is presented below.

Instead of changing the amplifier gain, another method of antenna gain control can include the use of a dual range attenuator interposed between the antenna and the amplifier, allowing the amplifier to run at a constant gain, but reducing the signal input level to achieve substantially the same result.

Additionally, another embodiment of the invention includes the use of multiple switch positions along with multiple resistors that provide for additional gain ranges. This system can also be used with separate VHF and UHF amplifiers, as well as separate controls for each amplifier, or shared amplifiers may be used.

Tests were made on an arrangement with dual transistor amplifiers arranged generally as described below in FIGS. 8 and 9. In these tests, a standardized, calibrated sweep RF generator and antenna generated an RF signal the frequency of which swings from near to 50 MHz up to around 870 MHz, a sweep covering both the VHF and UHF television frequency ranges. At some distance from this transmitter, a circular UHF antenna and a dipole VHF antenna were established and were connected to a dual amplifier version of the invention, with both resistor switching and also potentiometer adjustable gain control, as will be described below.

Figure 4:
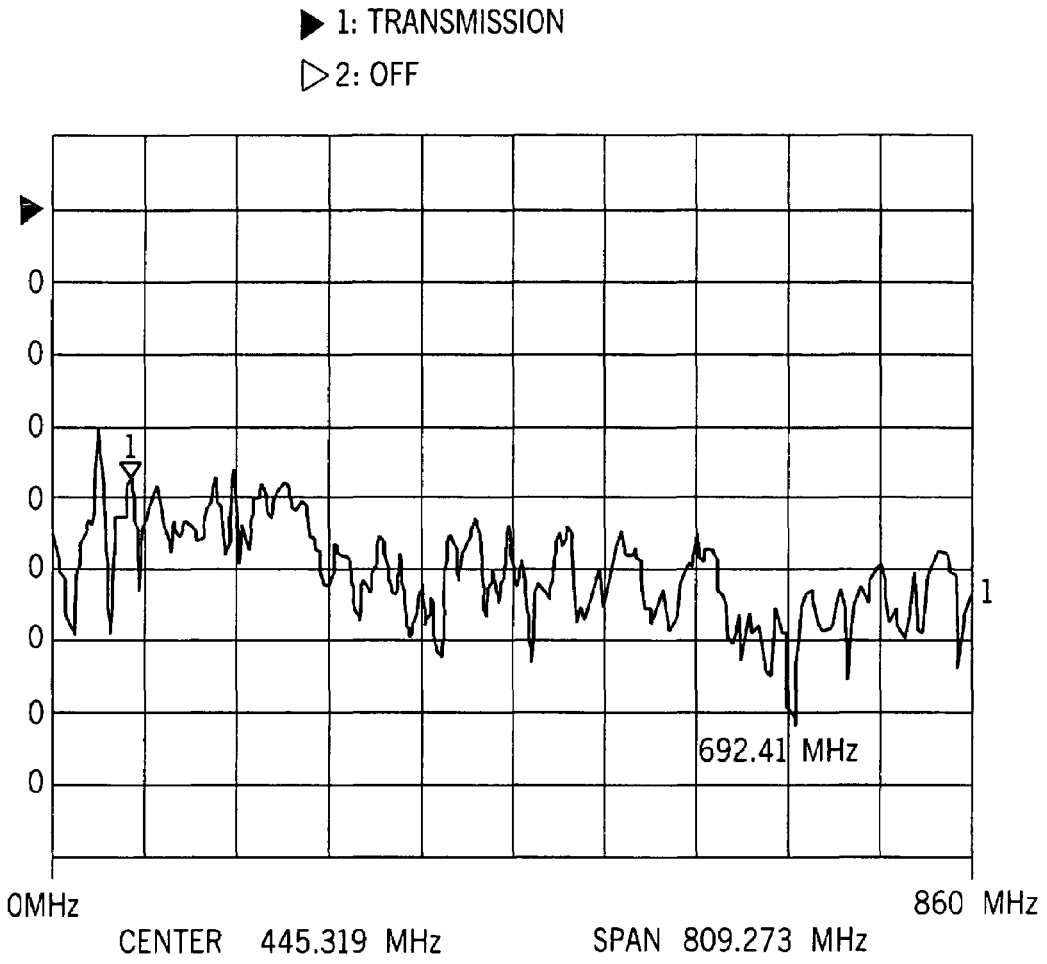
FIG. 4 is a plot showing the gain of a dual UHF-VHF antenna system plotted over the range of normal television frequencies (50 MHz to 875 MHz)
Figure 5:
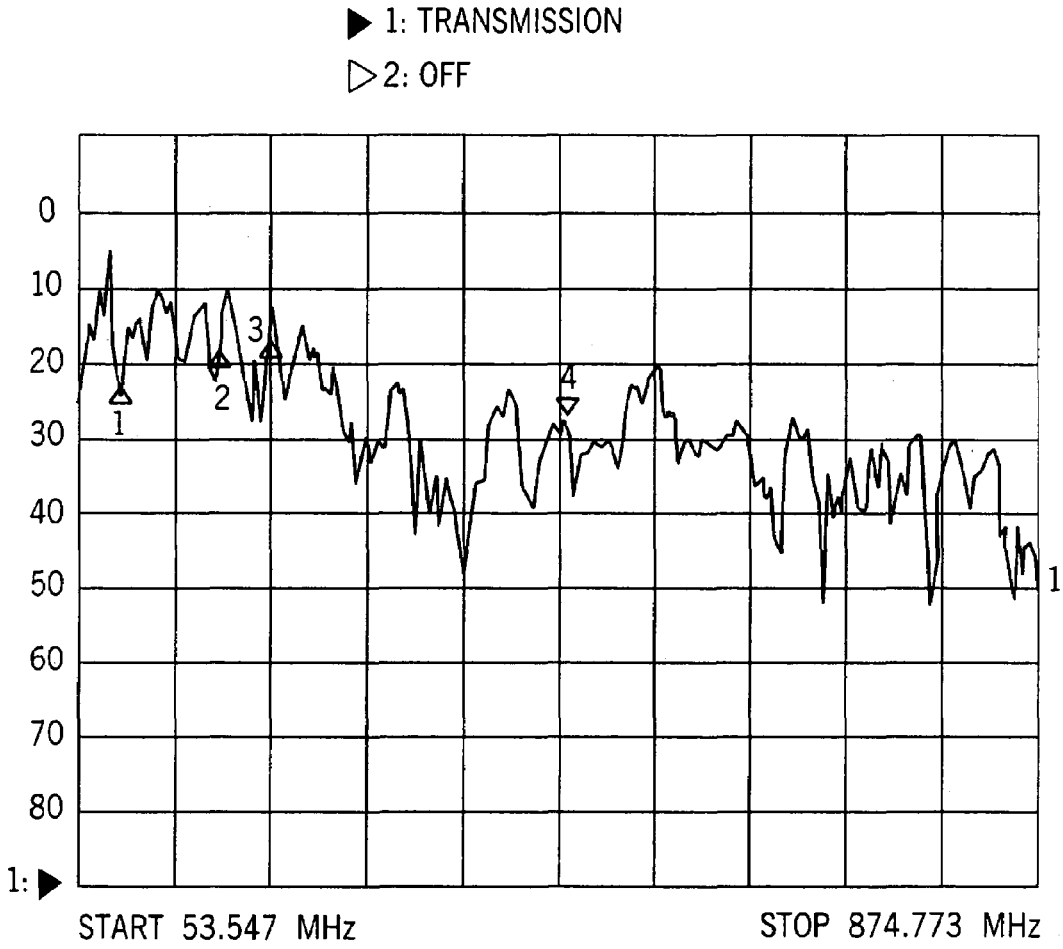
FIG. 5 is a plot showing the gain of the antenna system supplemented with dual amplifiers rated at 45 decibels of gain.
Figure 6:
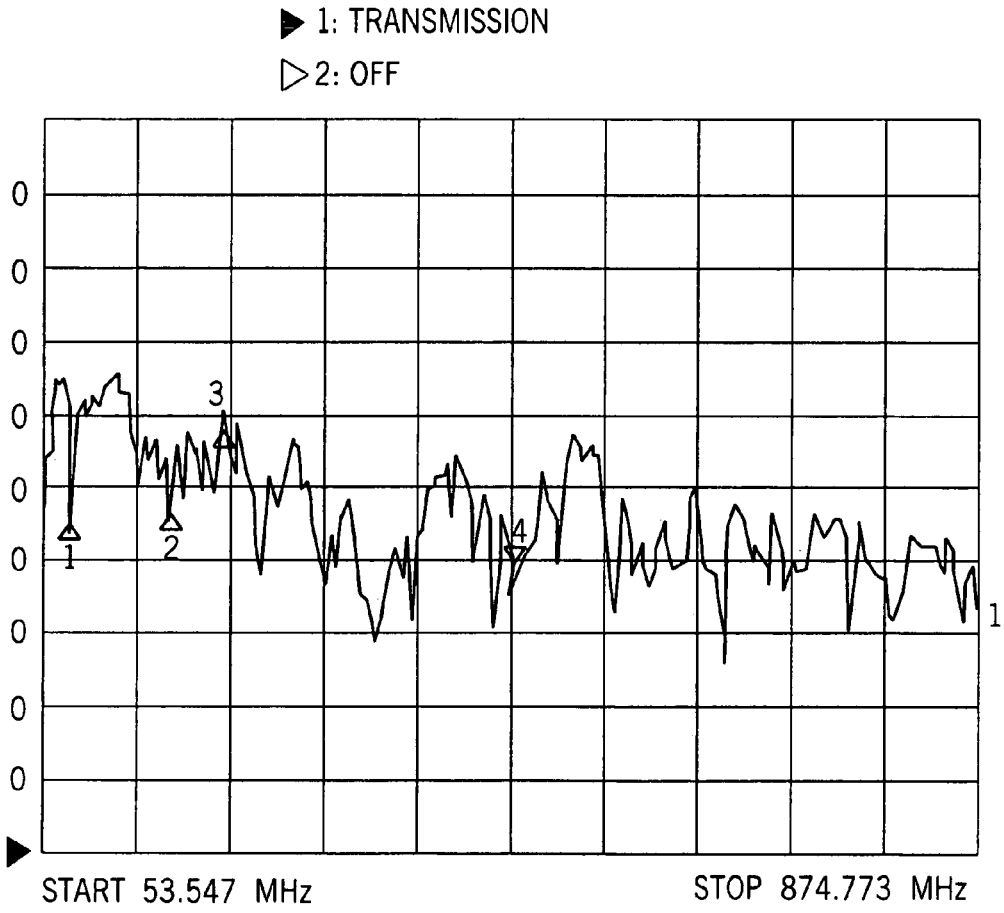
FIG. 6 is a plot showing the gain of the antenna system and dual amplifiers with Hi-Lo gain switches thrown to the low gain position.
Figure 7:
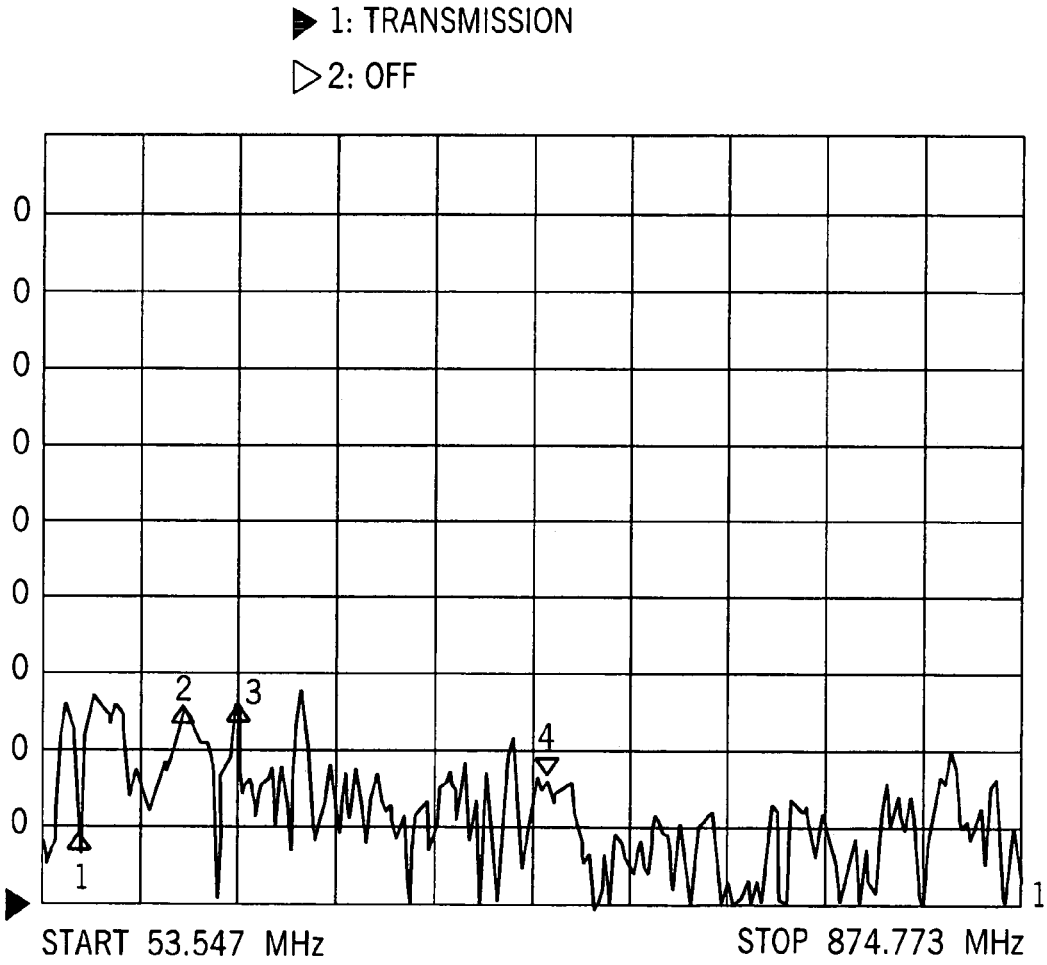
FIG. 7 is a plot showing the gain of the antenna system and dual amplifiers adjusted to provide minimum gain.

FIG. 4 illustrates the result of this experiment with the amplifiers removed. It can be see that the overall gain varies from −40 decibels at lower frequencies downwards to −50 decibels at intermediate frequencies and to between −50 and −60 decibels downwards at higher frequencies. FIG. 5 illustrates that when a dual transistor amplifier is entered into this circuit, and with the gain control adjustments set to give maximum gain, the overall gain now is between −10 and −20 decibels for low frequencies, around −30 decibels for intermediate frequencies, and between −30 and −40 decibels for the highest frequencies. When the VHF and UHF gain control switch 30 is thrown, FIG. 6 shows that the overall gain drops down to between −30 and −40 decibels for low frequencies, between −40 and −50 decibels for intermediate frequencies, and around −50 decibels for high frequencies, with the resistors 64 and 66 (FIG. 8) being chosen to give these results. When the two gain control potentiometers 24 and 22 are completely adjusted down to give minimum gain, FIG. 7 illustrates that the gain is now set to −70 and −80 for the lower half of the frequency range of interest and to −80 to 90 for the upper half of the frequency range of interest, thus giving strong protection from overloading the input circuitry of a TV set when in a very strong signal area or near a transmitter.

Figure 8:
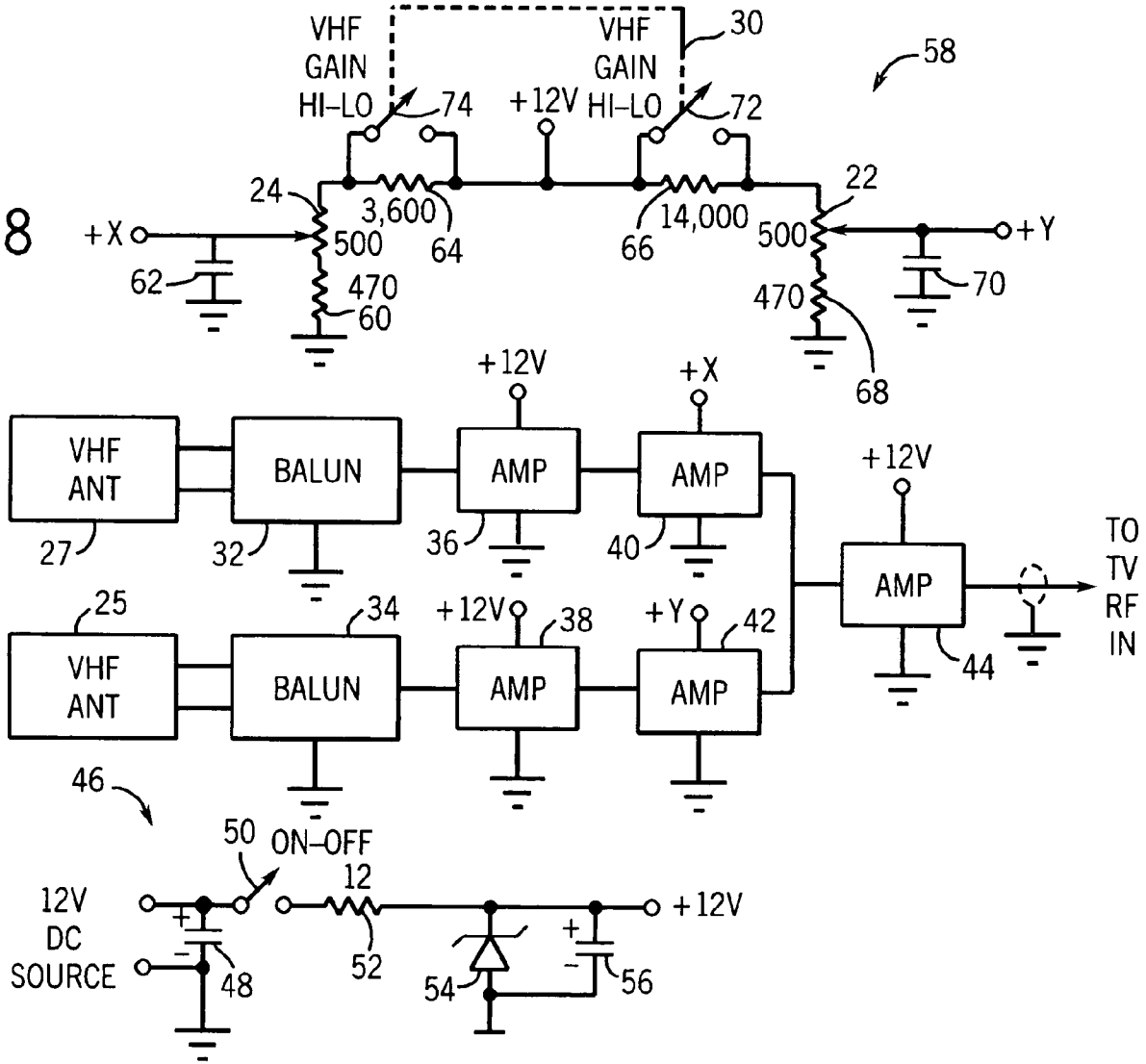
FIG. 8 is a partly block and partly circuit diagram of amplifiers and gain control circuitry connected to the UHF and VHF components of the antenna system.

FIG. 8 illustrates one potential arrangement of the elements of the present invention in a practical system. The VHF antenna 27 and the UHF antenna 25 are shown feeding their 300 ohm, two wire, balanced signals through respective baluns 32 and 34 which transform the 300 ohm balanced signals into higher impedance single wire signals unbalanced with respect to ground. The VHF unbalanced signal then flows from the balun 32, through a pair of amplifiers 36 and 40, and into a third amplifier 44 that produces a 75 ohm unbalanced signal which flows through a shielded coaxial cable to the TV RF input of a television receiver (not shown). Likewise, the UHF unbalanced signal flows from the balun 34 through a pair of amplifiers 38 and 42 and into the same third amplifier 44, such that the UHF and VHF signals are mixed together by the amplifier 44 and impedance matched to the 75 ohm coaxial cable that connects to the television receiver.

The two first stage amplifiers 36 and 38 and the third stage amplifier 44 have their power supply terminals marked +12v in FIG. 8 and connected to a +12 volt supply 46, shown in FIG. 8 at the bottom. The two second stage amplifiers 40 and 42 have their power supply terminals +X and +Y in FIG. 8 respectively connected to the +X and +Y variable voltage output terminals of a dual variable power supply 58 shown at the top of FIG. 8.

This dual variable power supply 58 (see FIG. 8) includes in its circuitry the two switches 72 and 74 which are ganged together mechanically (into a double-pole, single-throw slide switch 30, shown in FIG. 1) and used to switch between a lower and higher gain range, as has been explained. The switch 72 is labeled "VHF GAIN HI-LO", and the switch 74 is labeled "UHF GAIN HI-LOW." These two switches do not need to be ganged together—instead, they can be two separate switches that are individually adjustable. Also included in the circuitry of the dual variable power supply are the two potentiometers 22 and 24 which provide continuous gain adjustment.

The +12 volt supply 46 is provided with DC power from a nominally 12 volt DC source, such as a power cube or battery or the like. Other voltage levels can be chosen. An electrolytic capacitor 48 connected across the source of supply smoothes out the source of supply, eliminating ripples and hum. An optional ON-OFF switch 50 connects the positive supply terminal through a 12 ohm resistor 52 to a voltage regulating Zener diode 54 across which is connected a second ripple filtering electrolytic capacitor 56 to provide a regulated, filtered, and stable +12 v supply voltage. This supply voltage connects to the power terminals of the amplifiers 36, 38, and 44 either directly, as shown, or indirectly through additional series resistors and capacitors to ground to give additional filtering and isolation between amplification stages, if needed. Also, in addition to electrolytic capacitors needed to eliminate ripples and hum, there may be a need for smaller RF frequency bypassing capacitors (not shown) to be connected into the power supply wiring at various points to prevent spurious RF signals from flowing between stages over the power supply lines, as is well understood by RF circuit designers.

This regulated +12 volts DC also flows into the dual variable power supply 58 which produces the adjustable output voltages +X and +Y that power the variable gain amplifiers 40 and 42. In an alternative arrangement, the +X variable voltage signal can be supplied to both the amplifiers 36 and 40, and the +Y variable voltage signal can be supplied to both the amplifiers 38 and 42. Capacitors 62 and 70 are respectively connected from +X to ground and from +Y to ground, and these may be electrolytic capacitors, RF frequency bypass capacitors, or some combination of the two types of capacitors as needed to suppress ripple, provide good isolation between amplification stages, and to prevent spurious RF signals from floating around within the circuitry.

The voltages +X and +Y are derived by tapping into varying points on three resistors connected serially between +12 volts and ground potential. On the +Y side of the dual variable power supply 58, the three resistors 66, 22 (which is a potentiometer resistor), and 68 are connected in series to form a resistive circuit between +12 volts and ground. By tapping into varying points on the surface of the potentiometer 22's resistance, the slider of the potentiometer 22 is able to connect +Y to varying voltage levels. Thus, when the potentiometer 22 is adjusted, the voltage +Y rises and falls, and this varies the gain of the amplifier 42. Likewise, the switch 72 is arranged to either short circuit the resistor 66, thereby stepping up the voltage at +Y, or to open circuit the resistor 66, thereby stepping down the voltage at +Y.

On the +X side of the dual variable power supply 58, the three resistors 64, 24 (which is a potentiometer resistor), and 60 are likewise connected in series to form a resistive circuit between +12 volts and ground. By tapping into varying points on the surface of the potentiometer 24's resistance, the slider of the potentiometer 24 is able to connect +X to varying voltage levels. Thus, when the potentiometer 24 is adjusted, the voltage +X rises and falls, and this varies the gain of the amplifier 40. The switch 74 is also arranged to either short circuit the resistor 64, thereby stepping up the voltage at +X, or to open circuit the resistor 64, thereby stepping down the voltage at +X.

Figure 9:
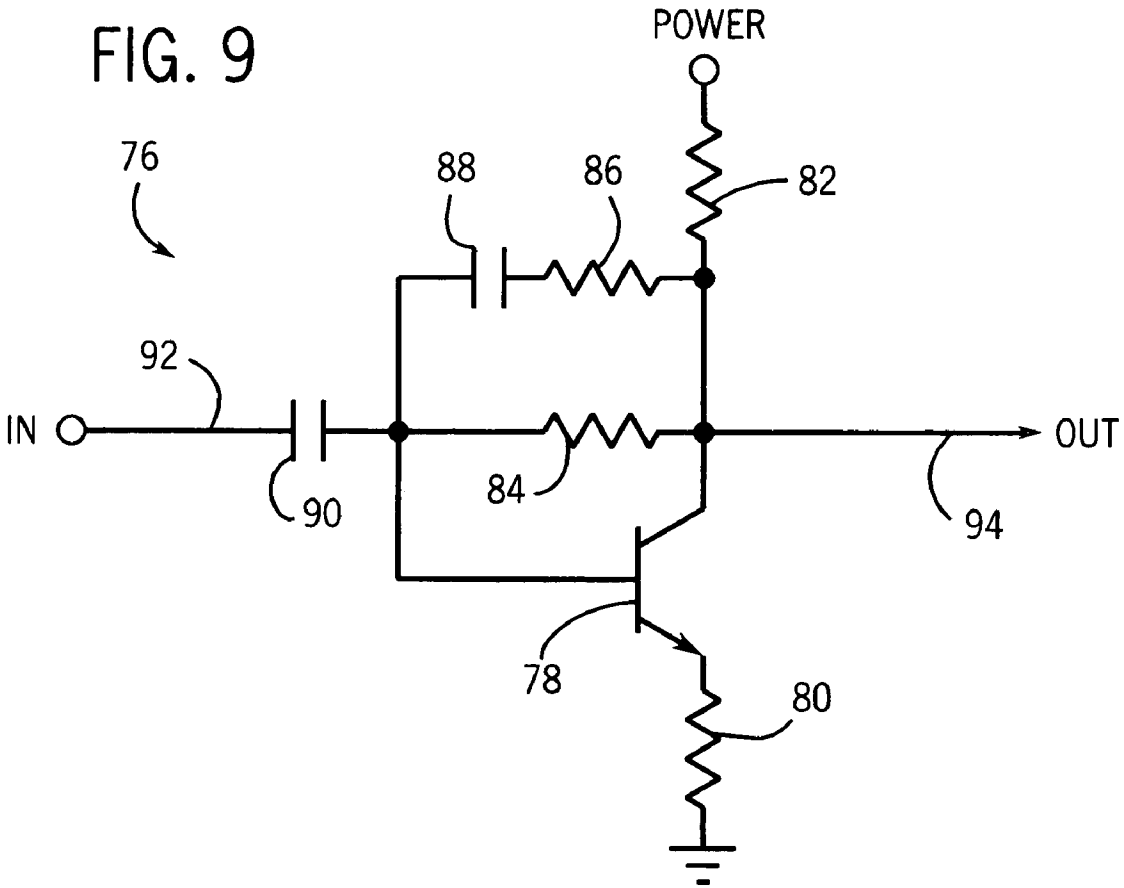
FIG. 9 is a circuit diagram of an RF amplifier suitable for use in a gain control arrangement.

A suitable RF transistor amplifier 76 is shown in FIG. 9. The amplifier 76 could, for example, serve as any of the amplifiers 36, 38, 40, 42, or 44 in FIG. 8. With reference to FIG. 9, a high frequency bipolar NPN transistor 78 is shown having its emitter connected to ground by a small valued resistor 80, while its collector is connected to a source of POWER by a medium valued resistor 82. DC current is provided from collector to base by a relatively high resistance resistor 84 the value of which is adjusted to center the operating point of the transistor 78 properly to give good, linear operation and also to facilitate gain adjustment. A much lower resistance resistor 86 is connected in series with an RF signal coupling capacitor 88 from collector to base, the value of which resistor 86 establishes both the gain of the amplifier stage as well as its output impedance, which is again chosen to give the desired operating characteristics for the particular amplifier stage. The incoming RF signal 92 is fed into the base of the transistor 78 through an RF coupling capacitor 90, and the output 94 is taken from the collector of the transistor 78, either directly or through another RF coupling capacitor (not shown). Gain control is achieved by simply varying the DC voltage applied to the POWER terminal of the collector resistor 82.

It should be understood that the above description of the invention and the specific examples and embodiments therein, while indicating the preferred embodiments of the present invention, are given only by demonstration and not limitation. Many changes and modification within the scope of the present invention may therefore be made without the parting from the spirit of the invention, and the invention includes all such changes and modifications.

What is claimed is:

1. A television set antenna system suitable for use both in weak signal areas and in strong signal areas comprising:

a housing that supports a UHF antenna and a VHF antenna each having output signal conducting wires extending within the housing;

mounted on the housing's surface, at least one gain adjustment switch, a pair of gain adjustment movable members, and an RF signal output compatible with a standard RF input of a television set;

within the housing, a pair of serial RF circuits each comprising a balun and at least two amplifiers oriented to amplify signals flowing from the balun towards the amplifiers, at least one of which amplifiers in each serial RF circuit includes a gain control mechanism and a gain control signal input, the wires from the UHF antenna connecting to the first of the two baluns, the wires from the VHF antenna connecting to the second of the two baluns, and the final amplifier in each serial RF circuit having an output connecting to the RF signal output;

within the assembly, a pair of gain control signal generators each including and having its gain control signal adjusted by one of the gain adjustment movable members and each also having its gain control signal adjusted by the gain adjustment switch.

2. A system as in claim 1 wherein the gain adjustment movable members are potentiometers.

3. A system as in claim 1 wherein the gain adjustment movable members are rotary potentiometers.

4. A system as in claim 2 wherein the gain control signal generators are adjustable DC power supplies the output voltage of which are controlled by the potentiometers and by the gain adjustment switch, and wherein the gain control signal inputs are also the power inputs of the amplifiers having such inputs.

5. A system as in claim 1 wherein the gain control signal generators are adjustable DC power supplies the output voltage of which are controlled by the gain adjustment movable members and by the gain adjustment switch, and wherein the gain control signal inputs are also the power inputs of the amplifiers having such inputs.

6. A system as in claim 1 wherein each of the two serial RF circuits comprises at least three amplifiers, and wherein at least the middle amplifier in each of the two serial RF circuits has the gain control mechanism.

7. A system in accordance with claim 6 wherein at least the first and middle amplifier in each of the two serial RF circuits has the gain control mechanism.

8. A system in accordance with claim 7 wherein the third amplifier is shared between the two serial RF circuits.

9. A system in accordance with claim 6 wherein the third amplifier is shared between the two serial RF circuits.

* * * * *